US006279475B1

(12) United States Patent
Cardoso

(10) Patent No.: US 6,279,475 B1
(45) Date of Patent: Aug. 28, 2001

(54) APPARATUS FOR SUPPLYING FLOWABLE PRINTING INK TO A PRINTER FOR CIGARETTE PAPER WEBS

(75) Inventor: Jose Cardoso, Boissy-la-Rivière (FR)

(73) Assignee: Decouflé s.a.r.l., Chilly-Mazarin Cedex (FR)

( * ) Notice: Subject to any disclaimer, the term of this patent is extended or adjusted under 35 U.S.C. 154(b) by 0 days.

(21) Appl. No.: 09/419,809

(22) Filed: Oct. 18, 1999

(30) Foreign Application Priority Data

Oct. 16, 1998 (DE) ..... 198 47 767

(51) Int. Cl.[7] ..... B41F 31/28
(52) U.S. Cl. ..... 101/351.8; 101/366
(58) Field of Search ..... 101/212, 216, 101/219, 335, 351.8, 366

(56) References Cited

U.S. PATENT DOCUMENTS

| | | | | |
|---|---|---|---|---|
| 3,199,451 | | 8/1965 | Nitchie | 101/366 |
| 3,345,943 | | 10/1967 | Rakowicz et al. | 101/366 |
| 3,553,371 | * | 1/1971 | Suenaga | 358/501 |
| 3,974,007 | | 8/1976 | Greve | 156/378 |
| 4,013,037 | | 3/1977 | Warning, Sr. et al. | 118/685 |
| 4,121,595 | | 10/1978 | Heitmann et al. | 131/281 |
| 4,423,676 | * | 1/1984 | Neel | 101/211 |
| 4,535,693 | | 8/1985 | Belvederi | 101/366 |
| 4,914,522 | * | 4/1990 | Duffield et al. | 358/190 |
| 5,018,444 | * | 5/1991 | Schumacher et al. | 101/351.8 |
| 5,575,208 | | 11/1996 | Kirihara | 101/366 |
| 5,724,890 | * | 3/1998 | Deschner et al. | 101/366 |

FOREIGN PATENT DOCUMENTS

| | | | |
|---|---|---|---|
| 12 18 474 | | 6/1966 | (DE) . |
| 1 950 236 | | 6/1970 | (DE) . |
| 196 48 567 | | 5/1998 | (DE) . |
| 0 815 949 | | 1/1998 | (EP) . |
| 513260 | | 2/1921 | (FR) . |
| 10-180988 | * | 7/1998 | (JP) . |

* cited by examiner

*Primary Examiner*—Daniel J. Colilla
(74) *Attorney, Agent, or Firm*—Venable; Robert Kinberg

(57) ABSTRACT

A running strip of cigarette paper or the like is provided with printed matter by the profiled peripheral surface of a printing roller which receives ink from one of several rollers including a pair of transfer rollers defining a nip which receives ink from an adjustable nozzle. The latter is movable back and forth longitudinally of the nip by an electric or other suitable motor receiving signals from a programmed control unit by way of an amplifier. The control unit regulates the speed of the nozzle and hence the distribution on, and the rate of delivery of printing ink to, the peripheral surface of the printing roller.

13 Claims, 2 Drawing Sheets

APPARATUS FOR SUPPLYING FLOWABLE PRINTING INK TO A PRINTER FOR CIGARETTE PAPER WEBS

CROSS-REFERENCE TO RELATED CASES

This application claims the priority of German patent application Serial No. 198 47 767.8 filed Oct. 16, 1998. The disclosure of the German patent application, as well as that of each US and foreign patent and patent application mentioned in the specification of the present application, is incorporated herein by reference.

BACKGROUND OF THE INVENTION

The invention relates to improvements in apparatus for supplying flowable printing ink to a printer for webs or strips of flexible sheet material, such as cigarette paper. More particularly, the invention relates to improvements in apparatus for supplying a flowable mixture of printing ink and a compressed gas to the inlet portion of a printer the outlet portion of which applies printing ink to the running strip.

A cigarette rod making machine employs a maker of a continuous rod-like filler of smokable material, such as natural, artificial and/or reconstituted tobacco, and an envelope which is a converted web or strip of cigarette paper draped around the rod-like filler in such a way that the marginal portions of the strip overlie each other and form a tubular wrapper with a seam extending longitudinally of the thus obtained continuous cigarette rod. The leader of the cigarette rod is thereupon severed at regular intervals so that the cigarette rod yields a file of discrete plain cigarettes of unit length or multiple unit length ready to be admitted into storage, into the magazine of a packing machine, or directly into a filter tipping machine wherein the plain cigarettes are united with filter mouthpieces to form therewith filter cigarettes of unit length or multiple unit length.

As a rule, the web of cigarette paper is provided with printed matter prior to entering the wrapping station. For example, the running web or strip of cigarette paper is normally provided with so-called stamped matter or imprint which can represent the trademark or the trade name of the manufacturer and/or distributor of cigarettes and/or other information. In order to ensure that the printed matter applied to short or long series of discrete plain or filter cigarettes (and more particularly to a practically endless length of cigarette paper ahead of the wrapping station) will satisfy the most exacting requirements, not only the quality of each imprint must be considered with great care, but it is equally important to many smokers to ensure that the shade and/or other characteristics of printed matter on each of a practically infinite number of successively turned out plain or filter cigarettes be selected and maintained with an utmost degree of accuracy. In many or most instances, the degree of accuracy depends upon the rate at which printing ink is being released or discharged from a source, e.g., a cartridge. Such cartridge is often installed to discharge printing ink onto so-called feeding rollers which, in turn, transfer ink onto a roller having a profiled peripheral surface coming into actual ink-applying contact with selected portions of one side of the running strip. Reference may be had, for example, to published German patent application Serial No. A1 196 48 567.

OBJECTS OF THE INVENTION

An object of the present invention is to provide an apparatus which can supply ink to a profiled printing roller with a much higher degree of reliability, accuracy and reproducibility than heretofore known apparatus.

Another object of the invention is to provide the apparatus with novel and improved means for supplying flowable printing ink to the printer.

A further object of the invention is to provide a novel and improved arrangement for continuously monitoring the quality of the printing action.

An additional object of the instant invention is to provide a novel and improved method of regulating the delivery of flowable printing ink in an apparatus which serves to apply printed matter to a running strip or web, such as a strip of cigarette paper or a material which is used to make envelopes or wrappers for rod-like fillers of filter mouthpieces.

Still another object of the invention is to provide a novel and improved combination of ink storing means, ink atomizing means and ink applying means for use in an apparatus of the above outlined character, particularly in a printer which can be put to use in a cigarette rod making machine.

A further object of the invention is to provide rod-shaped smokers' products which are provided with printed matter in the apparatus and in accordance with the method of the present invention.

Another object of the invention is to provide an apparatus which renders it possible to achieve considerable savings in printing ink.

An additional object of the invention is to provide an apparatus which reduces the likelihood of undue accumulations of printing ink on those portions of a printing roller which are not in use to transfer ink onto a running strip or web of paper or the like.

SUMMARY OF THE INVENTION

The apparatus of the present invention is constructed and assembled to apply a flowable mixture of a printing ink and a compressed gas (such as air) to a printer for the application of printing ink to a running elongated strip of imprintable material (such as cigarette paper) in the form of a pattern the imprinting of which necessitates the application of printing ink at a predetermined rate. The improved apparatus comprises a nozzle having a mixture-receiving inlet and an outlet for directing the mixture against the printer, and means for supplying the mixture to the inlet in quantities which vary as a function of the predetermined rate.

The apparatus further comprises means (e.g., one or more driven rotary components) for moving the strip lengthwise and, in accordance with an important and highly advantageous feature of the invention, means for moving the nozzle relative to the strip and more particularly relative to the printer.

The means for moving the nozzle can comprise means for reciprocating the nozzle and the means for reciprocating preferably comprises an adjustable prime mover and means for adjusting the prime mover as a function of the aforementioned predetermined rate. The prime mover can include an adjustable electric motor, and the adjusting means then preferably comprises means for transmitting to the electric motor electric signals; such electric signals exhibit or can exhibit characteristics which are dependent upon the aforementioned predetermined rate.

The electric motor or other selected adjusting means can be designed and mounted to reciprocate the nozzle at least substantially transversely of the moving strip. For example, the means for reciprocating the nozzle at least substantially transversely of the moving strip can comprise a variable-speed electric motor and means for transmitting to such motor electric signals to regulate the speed of the motor as a function of the predetermined rate.

The predetermined rate can be stored in a memory in the form of information which is addressed to operate the moving means; such information can be in the form of a so-called reference-print image, and the means for transmitting to the motor electric signals can comprise means for photoelectronically scanning the image and for generating signals for transmission to the moving means.

The printer can comprise a mobile (such as rotary) printing ink applicator which is arranged to contact and to transfer printing ink onto the running strip, and means for transferring ink from the outlet to the applicator including two rotary transfer members defining a nip arranged to receive a mixture of ink and compressed gas from the outlet.

The novel features which are considered as characteristic of the invention are set forth in particular in the appended claims. The improved apparatus itself, however, both as to its construction and the method of utilizing the same, together with numerous additional important and advantageous features and attributes thereof, will be best understood upon perusal of the following detailed description of certain presently preferred specific embodiments with reference to the accompanying drawings.

DESCRIPTION OF PREFERRED EMBODIMENTS

Figure 1:
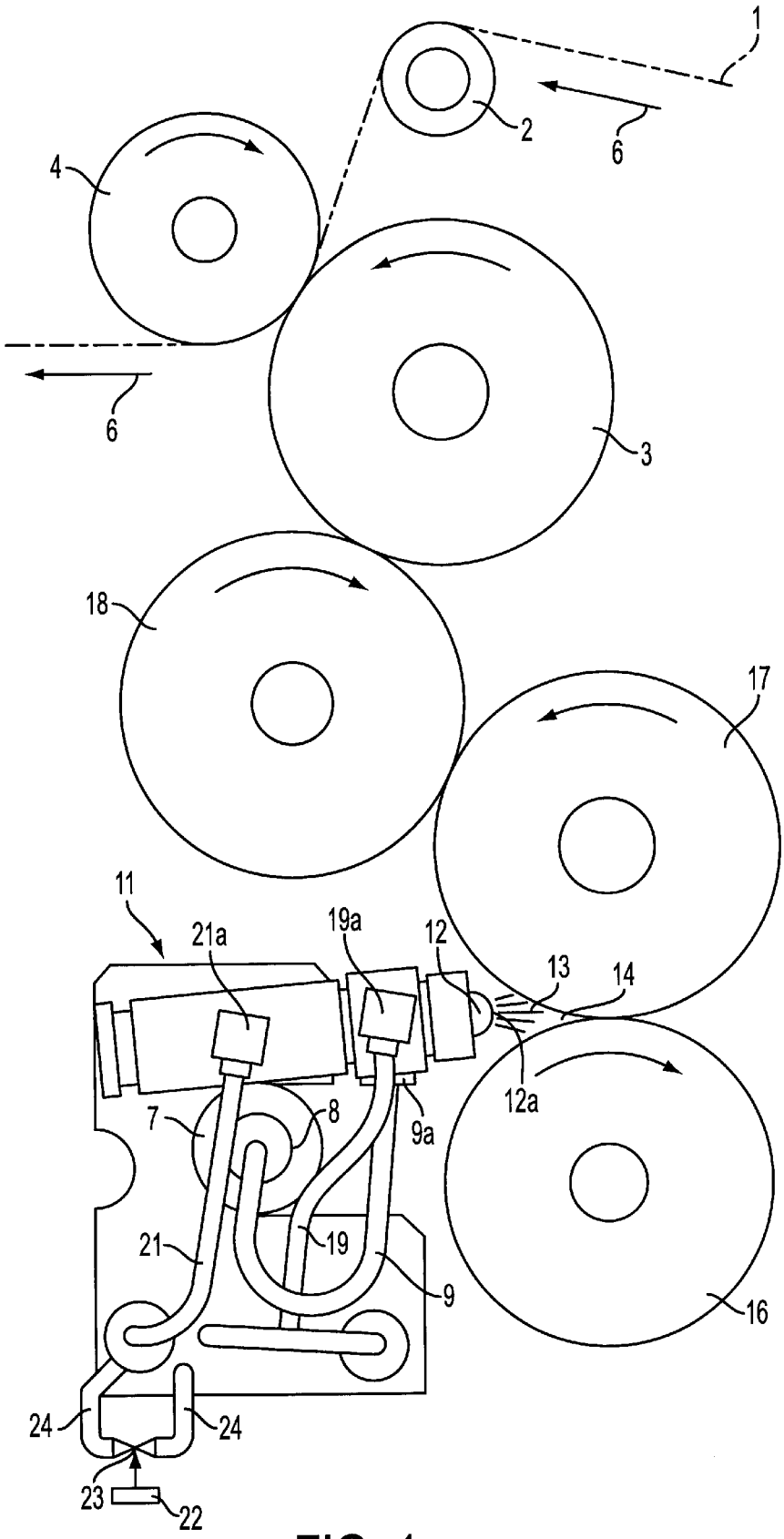
FIG. 1 is a schematic elevational view of a printing apparatus which embodies one form of the present invention.
Figure 2:
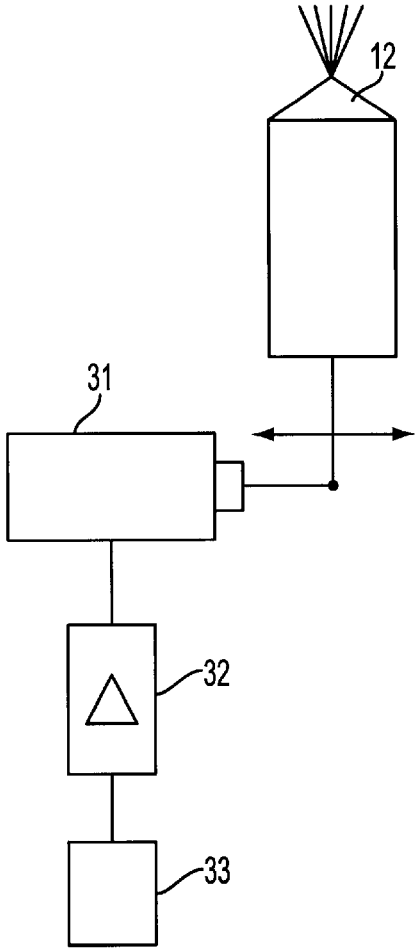
FIG. 2 is a schematic plan view of the nozzle and of the means for moving the nozzle relative to the nip of two rollers forming part of means for transferring ink to the profiled peripheral surface of the printing roller.

Several features of the apparatus which is shown in FIGS. 1 and 2 are shown and described in the aforementioned published German patent application Serial No. A1 196 48 567 to which reference can be had, if necessary. Thus, a suitable source (such as a bobbin or reel, not shown) supplies a continuous web or strip (hereinafter called strip) 1 of imprintable sheet material (such as cigarette paper) which is moved lengthwise (as indicated by the arrows 6) by suitable moving means including a driven roller 2.

The means for moving the strip 1 lengthwise further comprises two rollers 3, 4 which actually form part of the printer, namely of those constituents or components of the apparatus which serve to transfer printing ink from the outlet 12*a* of a nozzle 12 to one side of the running strip 1. The roller 3 is an applicator roller and is driven to rotate in a counterclockwise direction (as viewed in FIG. 1); it has a profiled peripheral surface including raised portions (not specifically shown) which transfer ink to the underside of the running strip 1. The roller 4 is or can constitute an idler roller which is caused (e.g., by the running strip 1) to rotate in a clockwise direction and is sufficiently close to the peripheral surface of the applicator roller 3 to ensure that the latter transfers ink from its raised portion or portions to the underside of the strip 1. Certain elementary forms of imprints which can be applied to the strip 1 are shown in and will be described with the reference to FIGS. 3, 4, and 5.

The flowable printing ink (preferably a low-viscosity atomizable and sprayable fluid) is stored in a suitable source or reservoir (FIG. 1 shows a standard cartridge 7) having an outlet 8 discharging into a conduit 9 which, in turn, discharges into the inlet 9*a* of a mixer or atomizer 11. The atomizer 11 discharges a mixture 13 of ink and a gaseous fluid (normally compressed air) into the inlet of the nozzle 12. The latter has an outlet 12*a* with one or more orifices serving to discharge the mixture 13 into the nip 14 of two rotary members 16, 17 forming part of the aforementioned printer further including the rollers 3, 4 and a further rotary member 18. The peripheral surfaces of the rotary members 16, 17 (which rotate in opposite directions) actually contact each other.

The rotary member 17 acts as a comminuting (e.g. grinding) implement which transfers a film of the coloring (non-gaseous) ingredient of the mixture 13 to the rotary member 18 and the latter coats the raised portion or portions of the peripheral surface of the roller-shaped applicator 3.

The atomizer 11 and the associated nozzle 12 can constitute a commercially available so-called "valve de pulverisation 780S" (translated as "atomizing valve or spray valve 780S") distributed by the Company DOSAGE 2000 s.a.r.l., 62–70 rue Yvan Tourgueneff, F-78380 Bougival, France. This atomizer receives ink (at 9*a*) from the cartridge 7 by way of the conduit 9. Conduits 19 and 21 are provided to supply compressed air to the inlets 19*a* and 21*a*. The purpose of compressed air which is being supplied to the inlet 19*a* via conduit 19 is to atomize the printing ink being supplied to the inlet 9*a*. On the other hand, compressed air being supplied to the inlet 21*a* via conduit 21 serves to meter the quantity of ink being supplied to the inlet of the nozzle 12. The quantity of ink being supplied to the inlet of the nozzle 12 is being metered as a function of changes of at least one parameter such as variations of forward speed (arrows 6) of the running strip 1.

The nozzle 12 is designed in such a way that it opens and closes its outlet 12*a* at a variable high frequency. Thus, if the speed of forward movement of the strip 1 increases, the ink requirements of the printer including the applicator 3 also increase and, therefore, the frequency at which the outlet 12*a* discharges ink per unit of time also increases. Alternatively, the reverse procedure is resorted to in order to meet the reduced requirements of the applicator 3 when the forward speed of the strip 1 decreases.

The means for monitoring the speed of the strip 1 comprises a timer 22 which controls a switching valve 23 as a function of the speed of the strip 1. The valve 23 is installed in a conduit 24 which supplies compressed air to the conduit 21 which (as mentioned above) supplies compressed air to the inlet 21*a* of the atomizer 11.

FIG. 2 shows a prime mover 31 which is a variable-speed reversible electric motor and constitutes a means for reciprocating the nozzle 12 along the nip 14 of the rotary members 16, 17 through a distance at most corresponding to the width of the strip 1. The motor 31 forms part of a means for moving the nozzle 12 relative to the strip 1, and such moving means further comprises an electronic signal amplifier 32 for the motor 31 as well as an electronic signal generating means 33 which transmits signals to the amplifier 32. The characteristics of signals being emitted by the signal generating means 33 are dependent upon the predetermined rate at which printing ink is being applied to the running strip 1 via printer including the driven rotary applicator 3. The signal generating means 33 preferably includes a memory for the storage of information, e.g., in the form of a so-called reference-point image adapted to be optoelectrically scanned by a suitable monitoring system including or being part of the electronic amplifier 32.

The mode of operation of the means 31–33 for moving the nozzle 12 relative to the strip 1 (actually relative to the nip 14) is or can be such that the back-and-forth movements of the nozzle 12 are slowed down or are brought to a complete halt when the applicator 3 is in need of a larger quantity of printing ink. On the other hand, if the applicator 3 rolls along a portion of the strip 1 which requires less printing ink, the speed of back-and-forth movements of the nozzle 12 along the nip 14 of the rolling members 16, 17 is increased so that the peripheral surface of the roller-shaped applicator 3 receives lesser quantities of printing ink.

The control circuit 33 is programmed in accordance with the so-called reference-print image of the matter to be imprinted upon successive increments of one side of the strip 1, and more particularly in dependency upon the printing ink requirements of the strip 1.

As already mentioned above, the circuit 33 can be programmed as a function of signals transmitted by the optoelectrical scanner of the circuit to the amplifier 32 (and hence to the motor 31) in response to addressing of the memory in the circuit 33.

Figure 3:
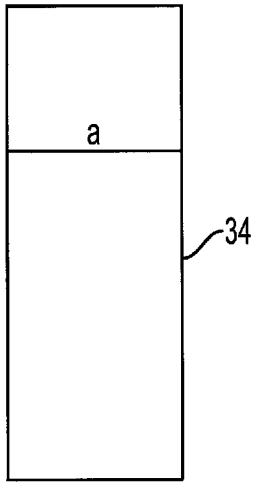
FIG. 3 is a schematic elevational view of a portion of a strip with a first form of information imprinted upon one side of the strip.

FIG. 3 shows schematically an image a imprinted upon a section (e.g., unit length) 34 of the strip 1 by the applicator 3 downstream of the rotary members 16, 17 as seen in the direction of flow of printing ink from the nip 14 of the rotary members 16, 17, by way of the member 17, and thereupon by way of the member 18. In FIG. 3, the image a is a straight line which extends transversely of the section 34 and all the way to the longitudinally extending marginal portions of this part of the strip 1.

Since the line a imprinted upon the section 34 extended all the way across the corresponding part of the strip 1, such part of the strip required a relatively large quantity of ink. Such requirements are accomplished by the aforementioned expedient of slowing down the movement of the nozzle 12 along the nip 14.

Figure 4:
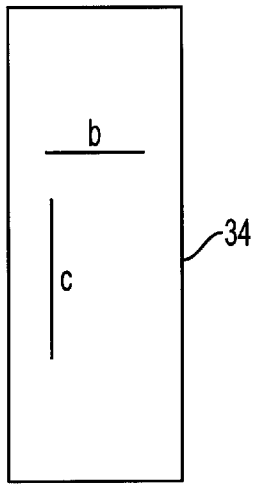
FIG. 4 is a similar elevational view of a portion of a strip bearing a different design.

FIG. 4 shows a different imprint b+c upon another section 34 of the strip 1. This composite imprint includes a longitudinally extending line c and a transversely extending line b extending transversely between but not all the way to the marginal portions of the strip section 34 shown in FIG. 4. The speed of the nozzle 12 has been reduced during travel along that portion of the nip 14 which corresponds to the left-hand part of the section 34 shown in FIG. 4. In other words, the reciprotatory movement of the nozzle was slowed down to ensure the transfer of requisite quantities of ink onto the part (section 34 of FIG. 4) which was to be provided with the composite imprint including the longitudinally extending line c (shorter than the length of the section 35) and the transversely extending line b (which is shorter than the width of the section 34 shown in FIG. 4).

Figure 5:
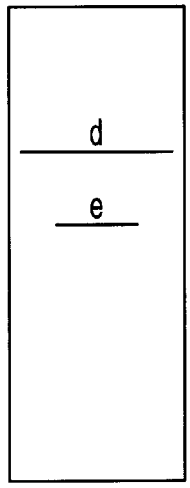
FIG. 5 is a similar view of a portion of a strip with a further imprinted design.

FIG. 5 shows a section corresponding to the section 34 of FIG. 3 or 4 but provided with a composite imprint d+e each part of which is a transversely extending line terminating short of the marginal portions of the strip. The speed of reciprocatory movement of the outlet 12*a* of the nozzle 12 along that portion of the nip 14 which received ink for the transfer to the corresponding portion of the peripheral surface of the applicator 3, i.e., the portion which is called upon to make linear imprints d and e on successive sections of he running strip 1, was relatively low.

An important advantage of the illustrated apparatus with the reciprocal nozzle 12, which receives motion from a variable-speed reciprocating prime mover 31, is that the rate of delivery of ink is optimized to suit the continuously or intermittently varying requirements of the applicator 3.

Another important advantage of the improved apparatus is that little (if any) ink goes to waste because the rate of ink delivery to the peripheral surface of the applicator 3 can be programmed to match the varying or constant requirements of the applicator 3 for printing ink. Absence of surplus ink, or of pronounced quantities of printing ink, entails a reduction or elimination of contamination of the printer 3,4, 16–18 with flowable ink.

The term "flowable printing ink" is intended to embrace readily flowable (low-viscosity) as well as not readily flowable (highly viscous) printing inks and the like.

Furthermore, though the application of imprints to cigarette paper is one of the presently preferred utilizations of the improved apparatus, it is equally possible to transfer ink to strips or webs of wrapping material for a rod-like filler of filter material for tobacco smoke or to strips of sheet material for the making of inserts for cigars. A machine which makes filter rod sections for use in filter tipping machines wherein plain cigarettes and filter rod sections are united to form filter cigarettes is disclosed, for example, in U.S. Pat. No. 3,974,007 granted Aug. 10, 1976 to Greve for "METHOD AND APPARATUS FOR THE PRODUCTION OF FILTER ROD SECTIONS OR THE LIKE". A machine wherein an imprinting mechanism is employed to repeatedly apply printed matter to a running web of cigarette paper is disclosed, for example, in U.S. Pat. No. 4,121,595 granted Oct. 24, 1978 to Heitmann et al. for "APPARATUS FOR INCREASING THE PERMEABILITY OF WRAPPING MATERIAL FOR ROD-SHAPED SMOKERS' PRODUCTS"; the apparatus of the present invention can be employed in lieu of or in addition to the imprinting apparatus of Heitmann et al.

The improved apparatus is susceptible of numerous additional modifications without departing from the spirit of the present invention. For example, the electric motor 31 and the controls 32, 33 therefor can be replaced with a hydraulically or pneumatically operated prime mover and appropriate controls therefor which enable the fluid-operated prime mover to move the nozzle 12 (or an equivalent nozzle) relative to the nip 14 in a manner and for the purposes as described above with reference to the operation of the electric motor 31. It has been found that, even if the electric motor 31 is replaced with another (such as fluid-operated) prime mover, the substitute prime mover is preferably and advantageously operated by an electrical and/or electronic control system. Such hovel means for moving the nozzle 12 and for regulating the rate of delivery of printing ink into the spray 13 can also ensure that the quantity of printing ink being supplied to the nip 14 during certain stages of application of ink to successive sections (such as 34) of the running strip 1 will entail considerable (actually maximal) savings in printing ink (and hence negligible, if any, unnecessary contamination of the novel apparatus) because the quantity of supplied printing ink matches (or at least very closely approximates) the requirements of the printer including the parts, 3, 4 and 16–18 (or an equivalent printer) during each of a series of intervals which elapse for the application of printed matter to successive sections of a running strip.

All of the above enumerated improvements can be accomplished with the novel expedient of regulating the speed and/or the extent of back-and-forth movements of the nozzle 12 to thus ensure a predetermined distribution of printing ink transversely of the running strip (such as the strip 1), i.e., the speed and the extent of reciprocatory movements of the outlet 12*a* of the nozzle 12 longitudinally of the nip 14 of the rotary members 16, 17.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of supplying flowable printing ink to printers and, therefore, such adaptations should and are intended to be comprehended within the meaning and range of equivalence of the appended claims.

What is claimed is:

1. Apparatus for supplying a flowable mixture of a printing ink and a compressed gas to a printer for the application of printing ink to a running elongated strip of imprintable material in the form of a pattern the imprinting of which requires different amounts of printing ink applied crosswise in a running direction of the elongated strip, comprising:

a nozzle having a mixture-receiving inlet and an outlet for directing the mixture against the printer;

means for moving the strip;

means for moving said nozzle crosswise relative to the strip at a speed based on the printing ink required for the pattern to be imprinted on the imprintable material; and means for supplying the mixture to said inlet in quantities based upon said speed.

2. The apparatus of claim 1, wherein said strip is cigarette paper.

3. The apparatus of claim 1, wherein said compressed gas is air.

4. The apparatus of claim 1, wherein said means for moving said nozzle comprises means for reciprocating the nozzle.

5. The apparatus of claim 1, wherein said means for moving said nozzle comprises an adjustable prime mover and means for adjusting said prime mover based on the printing ink required for the pattern to be imprinted on the imprintable material.

6. The apparatus of claim 5, wherein said prime mover includes an adjustable electric motor, and wherein said adjusting means includes means for transmitting to said motor electric signals.

7. Apparatus for supplying a flowable mixture of a printing ink and a compressed gas to a printer for the application of printing ink to a running elongated strip of imprintable material in the form of a pattern the imprinting of which necessitates the application of printing ink at a predetermined rate, comprising:

a nozzle having a mixture-receiving inlet and an outlet for directing the mixture against the printer;

means for moving the strip lengthwise;

means for moving said nozzle relative to the strip, wherein said means for moving said nozzle comprises: an adjustable prime mover including an adjustable electric motor, and means for adjusting said prime mover based on said predetermined rate, wherein said adjusting means includes means for generating electric signals having characteristics dependent upon said predetermined rate and means for transmitting said electrical signals to said motor; and means for supplying the mixture to said inlet in quantities based upon said predetermined rate.

8. The apparatus of claim 1, wherein said means for moving said nozzle comprises means for reciprocating the nozzle at least substantially transversely of the moving strip.

9. Apparatus for supplying a flowable mixture of a printing ink and a compressed gas to a printer for the application of printing ink to a running elongated strip of imprintable material in the form of a pattern the imprinting of which necessitates the application of printing ink at a predetermined rate, comprising:

a nozzle having a mixture-receiving inlet and an outlet for directing the mixture against the printer;

means for moving the strip lengthwise;

means for moving said nozzle relative to the strip, wherein said means for moving said nozzle comprises means for reciprocating the nozzle at least substantially transversely of the moving strip, wherein said means for reciprocating said nozzle comprises a variable-speed electric motor and means for transmitting to said motor electric signals to regulate the speed of the motor based on said predetermined rate; and means for supplying the mixture to said inlet in quantities based upon said predetermined rate.

10. The apparatus of claim 1, wherein said speed is stored in a memory in the form of information which is addressed to operate said means for moving said nozzle.

11. The apparatus of claim 10, wherein said information is a reference-print image.

12. Apparatus for supplying a flowable mixture of a printing ink and a compressed gas to a printer for the application of printing ink to a running elongated strip of imprintable material in the form of a pattern the imprinting of which necessitates the application of printing ink at a predetermined rate, comprising:

a nozzle having a mixture-receiving inlet and an outlet for directing the mixture against the printer;

means for moving the strip lengthwise;

means for moving said nozzle relative to the strip, wherein said predetermined rate is stored in a memory in the form of information which is addressed to operate said means for moving said nozzle, wherein said information is in the form of a reference-print page;

means for optoelectronically scanning said image and for generating signals for transmission to said means for moving said nozzle; and means for supplying the mixture to said inlet in quantities which vary as a function of said predetermined rate.

13. The apparatus of claim 1, wherein said printer comprises a printing ink applicator arranged to contact and to transfer printing ink onto the running strip, and means for transferring ink from said outlet to said applicator including two rotary members defining a nip arranged to receive a mixture of ink and compressed gas from said outlet.

* * * * *